United States Patent [19]

Effler, Jr.

[11] Patent Number: 4,757,808

[45] Date of Patent: Jul. 19, 1988

[54] LIQUID JET MASSAGE DEVICE

[76] Inventor: William T. Effler, Jr., 247 B Tulip Hill Dr., Nashville, Tenn. 37210

[21] Appl. No.: 876,927

[22] Filed: Jun. 20, 1986

[51] Int. Cl.[4] ..... A47C 19/12; A61H 9/00

[52] U.S. Cl. ..... 128/66; 4/542; 4/492; 5/451

[58] Field of Search ..... 128/66, 365–370, 128/373; 134/167 R; 239/227, 237, 240, 242, 243; 4/541, 542, 492; 5/451

[56] References Cited

U.S. PATENT DOCUMENTS

| | | | |
|---|---|---|---|
| 1,559,019 | 10/1925 | Todd et al. | 239/227 |
| 1,592,452 | 7/1926 | Ferris et al. | 239/243 |
| 1,982,259 | 11/1934 | Martin | 128/66 |
| 2,622,927 | 12/1952 | Sarbu | 239/240 |
| 3,694,263 | 9/1972 | Korn | 134/167 R |
| 3,766,911 | 10/1973 | Green | 128/66 |
| 4,163,455 | 8/1979 | Hebert et al. | 134/167 R |
| 4,220,145 | 9/1980 | Stamp et al. | 128/66 |
| 4,339,833 | 7/1982 | Mandell | 128/66 |
| 4,559,653 | 12/1985 | Mathews | 4/541 |
| 4,607,405 | 8/1986 | Ellis et al. | 128/66 |

FOREIGN PATENT DOCUMENTS

| | | | |
|---|---|---|---|
| 1807812 | 11/1968 | Fed. Rep. of Germany | 134/167 R X |
| 3044260 | 6/1982 | Fed. Rep. of Germany | 128/66 X |

OTHER PUBLICATIONS

"Dream Whirl Products", Advertisement in Floatation Sleep Industry, Mar. 1985, p. 61.

*Primary Examiner*—C. Fred Rosenbaum
*Assistant Examiner*—Ralph Lewis
*Attorney, Agent, or Firm*—Robert Pitts; Bradford Brittian; Martin Skinner

[57] ABSTRACT

A liquid jet massage device (10) for producing selectively rotating jets of liquid for massaging the body of a user. The device (10) comprises a movable carriage (13) provided with a conduit for carrying liquid dispensed to the carriage (13) by suitable pump system. The device (10) comprises at least one, and in the preferred embodiment two, liquid dispensing primary head members (11, 12) rotatably mounted on the movable carriage (13). The primary head members (11, 12) define a liquid reservoir (42) for receiving the liquid from the conduit (32), the bottom portions (40) of the head members (11, 12) defining axial openings (46) for establishing liquid communications between the reservoir (42) and the conduit (32). The top portion of the head members (11, 12) are provided with axially displaced nozzles (45) for discharging liquid from the reservoirs (42) thereby producing jets of liquid. The primary head members (11, 12) further define a circumferential gear surfaces (41) to facilitate rotation of the head members. A first gear assembly (16) is provided for facilitating the selective travel of the movable carriage, and a second gear assembly (17) is provided for rotatably engaging the circumferential gear surface of at least one of the primary head members for facilitating the selected rotation of the primary head members (11, 12).

12 Claims, 12 Drawing Sheets

LIQUID JET MASSAGE DEVICE

DESCRIPTION

TECHNICAL FIELD

The present invention relates to a liquid jet massage device for producing selectively rotating jets of liquid for massaging the body of a user. More specifically, in the preferred embodiment the massage device of the present invention comprises a pair of liquid dispensing head members rotatably mounted on a movable carriage.

BACKGROUND ART

It has long been recognized that focused jets of a liquid, such as water, impacting the body produce a massaging effect that is both enjoyable and therapeutic. Accordingly, numerous attempts have been made to construct devices which produce jets of liquid for massaging the body. For example, U.S. Pat. No. 4,523,340, issued June 18, 1985, and U.S. Pat. No. 4,339,833, issued July 20, 1982, disclose device utilizing liquid jets to produce a massaging effect. However, conventional devices which produce liquid jets for massage purposes tend to have limited mobility such that in order to massage various portions of the body, the body must be moved to encounter the jet of liquid rather than the jet of liquid being relocated to impact the desired portion of the body. Further, localized movement of the jet of liquid, as for example, rotational movement, enhances the massaging effect of the jet of liquid, and conventional device tends to lack the ability to produce controllable localized movement of the liquid jet.

Therefore, it is an object of the present invention to provide a liquid jet massage device for massaging the body of a user.

It is another object of the present invention to provide a liquid jet massage device which allows the jets of liquid to be moved to massage selected portions of the body without the necessity of repositioning the body to be massaged.

Still a further object of the present invention is to provide a liquid jet massage device which allows the localized rotation of the liquid jets to enhance the massaging effects of the jets of liquid.

Yet another object of the present invention is to provide a liquid jet massage device which is inexpensive to manufacture and to maintain.

DISCLOSURE OF THE INVENTION

Other objects and advantages will be accomplished by the present invention which provides a liquid jet massage device for producing rotating jets of liquid for massaging the body of a user. The massage device of the present invention generally comprises a movable carriage provided with a liquid conduit for receiving liquid pumped under pressure to the carriage by suitable pump means. At least one, and in the preferred embodiment two, liquid dispensing primary head members are rotatably mounted on the movable carriage, each such head member defining a circumferential gear surface for facilitating the rotation of such primary head member. Further, each of the rotating primary head members defines a liquid reservoir for receiving liquid from the conduit of the movable carriage. In this regard the bottom portion of each primary head member defines an axial opening through which liquid is received from the liquid conduit and received in the reservoir of the head member. Further, the top portion of each primary head member is provided with an axially displaced nozzle for discharging jets of liquid from the reservoir of the rotatable primary head members. Also provided are a first gear assembly for facilitating the selective travel of the movable carriage and a second gear assembly for facilitating the selective rotation of the primary head members. Still further, in one embodiment the massage device of the present invention is provided with liquid dispensing secondary head members rotatably mounted on the primary head members, and in another embodiment the primary head members are slidably mounted on the movable carriage to allow the spacing between the jets of liquid produced by the device to be altered.

BRIEF DESCRIPTION OF THE DRAWINGS

The above-mentioned features of the present invention will become more clearly understood from the following detailed description of the invention read together with the drawings in which.

BEST MODE FOR CARRYING OUT THE INVENTION

Figure 1A:
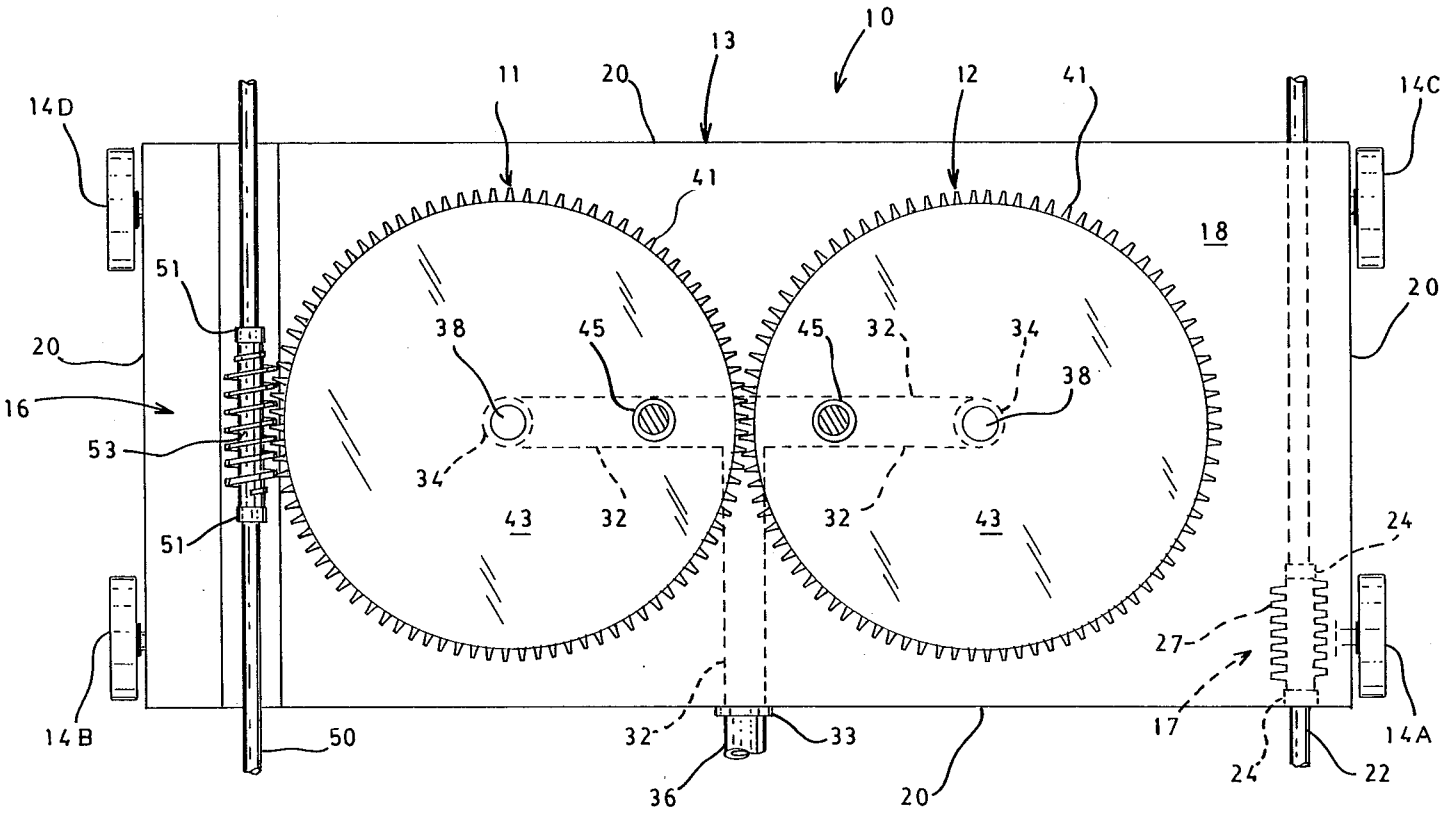
FIG. 1A is a top view of a massage device of the present invention.
Figure 1B:
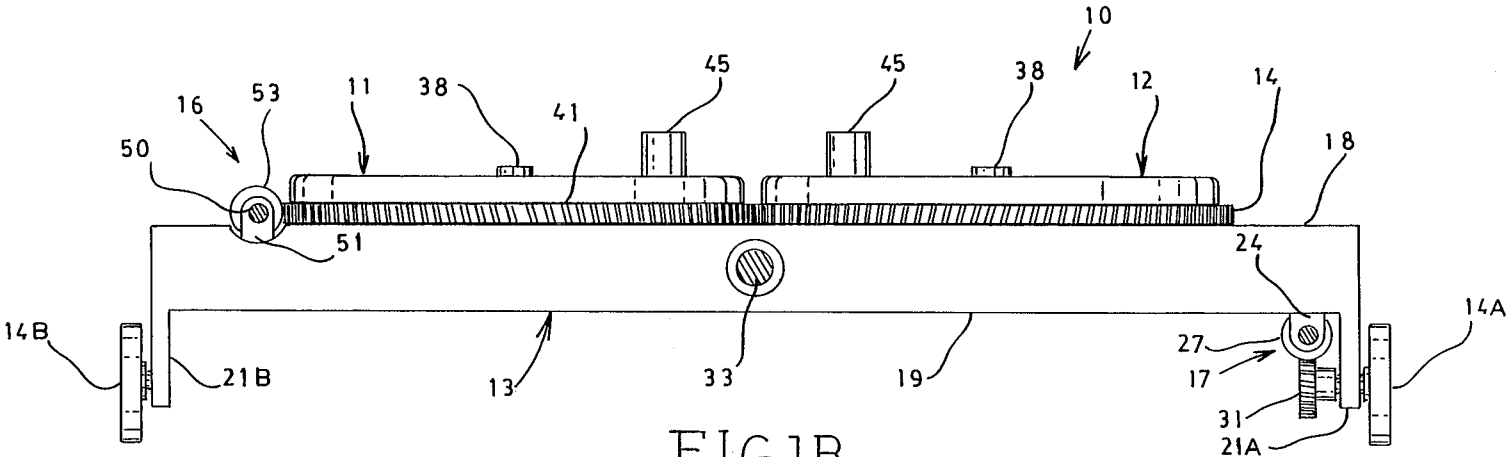
FIG. 1B is a rear view of a massage device of the present invention.
Figure 1C:
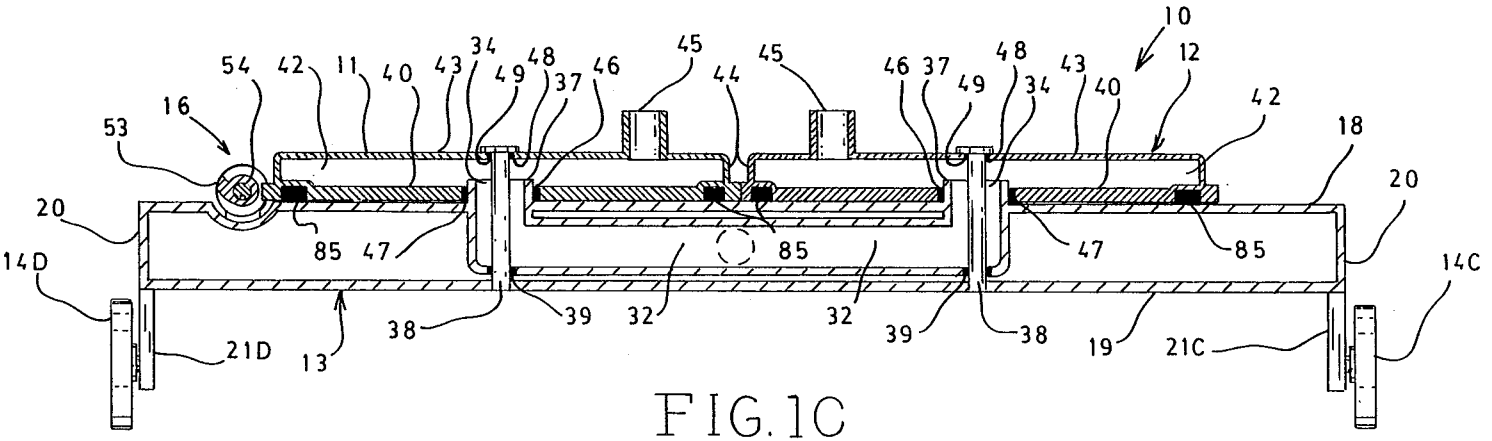
FIG. 1C is a rear view, in section, of a massage device of the present invention.

A liquid jet massage device incorporating various features of the present invention is illustrated generally at 10 in FIGS. 1A through 1C. As will become apparent from the discussion which follows, the massage device 10 is designed to be mounted in a bath tub, spa or other bathing reservoir, and provides at least one, and in the preferred embodiment two, rotating jets of fluid which impact the body of the user thereby producing a massaging effect which is both therapeutic and enjoyable. The massage device 10 generally comprises a pair of rotatable fluid dispensing head members 11 and 12 mounted on a movable carriage 13, the carriage 13 being provided with four rotatable wheel members 14A through D. Further, a first gear assembly 16 is provided to facilitate the selective rotation of the head members 11 and 12, and a second gear assembly 17 is provided to facilitate the selective movement of the carriage 13.

As is best illustrated in FIGS. 1B and 1C, the carriage 13 defines an enclosure comprising a top portion 18, a bottom portion 19 and side walls 20. Further, the carriage 13 comprises four (4) leg members 21A, B, C, and D, on which the wheel members 14A, B, C and D, respectively, are rotatably mounted. The carriage 13 is driven by a drive shaft 22 which can be selectively rotated by various motor means, certain of which will be discussed herein below.

Figure 9:
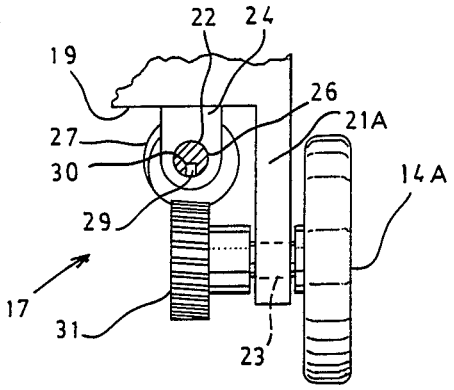
FIG. 9 is a rear view of the second gear assembly of the massage device of the present invention.

As is best illustrated in FIG. 9 in one preferred embodiment the wheel member 14A is mounted on an axle 23 which is in turn received through a suitable bearing (not shown) mounted in the leg member 21A. The second gear assembly 17 facilitates the rotation of wheel member 14A by communicating the rotation of the drive shaft 22 to the axle 23 resulting in rotation of the wheel member 14A. In this regard, the second gear assembly comprises a pair of yoke members 24 mounted on the bottom portion 19 of the carriage 13, the yoke members 24 defining registering holes 26 for slidably receiving the drive shaft 22. A first worm gear 27 is slidably mounted on the shaft 22 so as to be journalled between the yoke members 24. The worm gear 27 defines a hole (not shown) for slidably receiving the shaft 22, and defines a key portion 29 extending into the hole in the worm gear 27 for being slidably received in a keyway 30 defined in the shaft 22. It will be appreciated by those skilled in the art that this construction allows the first worm gear 27 to slidably travel along the shaft 22 while being selectively rotated by the drive shaft 22. The second gear assembly 17 also comprises a drive gear 31 which is mounted on the inboard end portion of the axle 23 and which meshes with the worm gear 27 such that as the worm gear 27 rotates the wheel member 14A rotates thereby resulting in movement of the carriage 13. Of course, it will be appreciated that the illustrated gear assembly 17 is merely one preferred gear assembly for facilitating the movement of the carriage 13, and other suitable gear assemblies can be utilized.

The carriage 13 further comprises a T-shaped fluid conduit 32 defining an inlet port 33 and a pair of oppositely disposed outlet ports 34 for carrying liquid to the rotating head members 11 and 12. As illustrated in FIG. 1A, and as will be discussed in detail below, fluid is communicated to the carriage 13 through a flexible hose 36 which is connected to the inlet port 33. Of course, the hose 36 is in turn connected to suitable pump means capable of pumping liquid, under pressure, to the carriage 13. Further, the conduit 32 defines a cylindrical mounting rim 37 protruding from the top portion 18 of the carriage 13 proximate each outlet port 34 for facilitating the rotational mounting of the head members 11 and 12. Also provided are a pair of mounting shafts 38 secured to the bottom portion 19 of the carriage 13 and extending upwardly through, and coaxial with, the mounting rims 37, the shafts 38 also being provided for securing the head members 11 and 12 in position on the carriage 13. Of course, since the mounting shafts 38 extend through the wall of the conduit 32, a pair of seal members 39 are provided to insure the liquid-tight integrity of the conduit 32.

Each of the rotating head members 11 and 12 comprises a circular bottom portion 40 defining a circumferential toothed gear surface 41. Further, each of the head members 11 and 12 defines a fluid reservoir 42 above the bottom portion 40 defined by a top portion 43 and annular side walls 44. The bottom portions 40 of the head members 11 and 12 are provided with axial openings 46 for rotatably receiving one of the mounting rims 37. As illustrated in FIG. 1C seal members 47 are oriented between the edges of the axial openings 46 and the mounting rims 37 to insure the fluid impervious integrity of the reservoir 42. Further, the top portion 43 of the each head member 11 and 12 defines an axial hole 48 for rotatably receiving an operatively associated mounting shaft 38, with a suitable seal member 49 being provided between the mounting shaft 38 and the edges of the axial hole 48 to insure the fluid impervious integrity of the reservoir 42. Thus, the head members 11 and 12 are rotatably mounted on the carriage 13 such that they selectively rotate about the operatively associated mounting rim 37 and the operatively associated mounting shaft 38, and, as illustrated, the gear surfaces of the head members 11 and 12 mesh such that rotational movement of one of the head members 11 or 12 results in rotational movement of the other head member 11 or 12 in an opposite direction. Also, in order to facilitate the free rotation of the head members 11 and 12 on the top portion 18 of the carriage 13, a plurality of selectively spaced roller bearings 85 are mounted between the head members 11 and 12 and the top portion 18.

Figure 8:
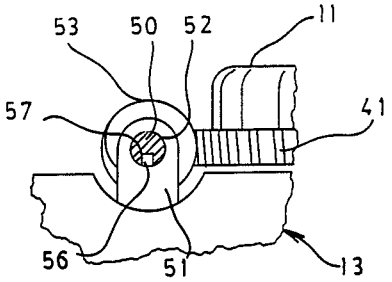
FIG. 8 is a rear view of the first gear assembly of the massage device of the present invention.

In order to accomplish the selective rotation for the head members 11 and 12, a second drive shaft 50 is provided which can be selectively rotated by various motor means, certain of which will be discussed herein below. The rotation of the shaft 50 is in turn communicated to the head member 11 by the first gear assembly 16. (see FIG. 8) The first gear assembly 16 comprises a pair of yoke members 51 mounted on the top portion 18 of the carriage 13, the yoke members 51 registering holes 52 for slidably receiving the drive shaft 50. A second worm gear 53 is slidably mounted on the shaft 50 so as to be journalled between the yoke members 51, and so as to mesh with the gear surface 41 of the head member 11. More specifically, the worm gear 53 defines a hole 54 for slidably receiving the shaft 50 and defines a key portion 56 extending into the passageway defined by the hole 54 for being slidably received in a key way 57 defined in the shaft 50. Thus, as with the worm gear 27 of the second gear assembly 17, the worm gear 53 is allowed to slidably travel along the shaft 50 while being selectively rotated by the drive shaft 50. Accordingly, the gear assembly 16 allows the carriage 13 to travel along shaft 50 while the worm gear 53 communicates the rotation of the drive shaft to the head member 11, the rotation of the head member 11 resulting in the rotation of the head member 12. Of course, the gear assembly 16 is merely one preferred gear assembly for facilitating the selective rotation of the head members 11 and 12, and other suitable gear assemblies can be utilized.

In light of the above it will be appreciated that the massaging jets of liquid are produced by injecting liquid, under pressure, into the inlet port 33 with the flexible hose 36. The liquid thus injected is communicated to the reservoirs 42 of the head members 11 and 12 by the conduit 32 and exits the selectively rotating head members 11 and 12 in upwardly directed jets through the nozzles 45. Given that the nozzles 45 are displaced from the axes of the head members 11 and 12 the rotation of the head members causes the liquid jets to be dispensed from each of the head members in a circular pattern, thereby enhancing the massage effect produced.

Figure 2A:
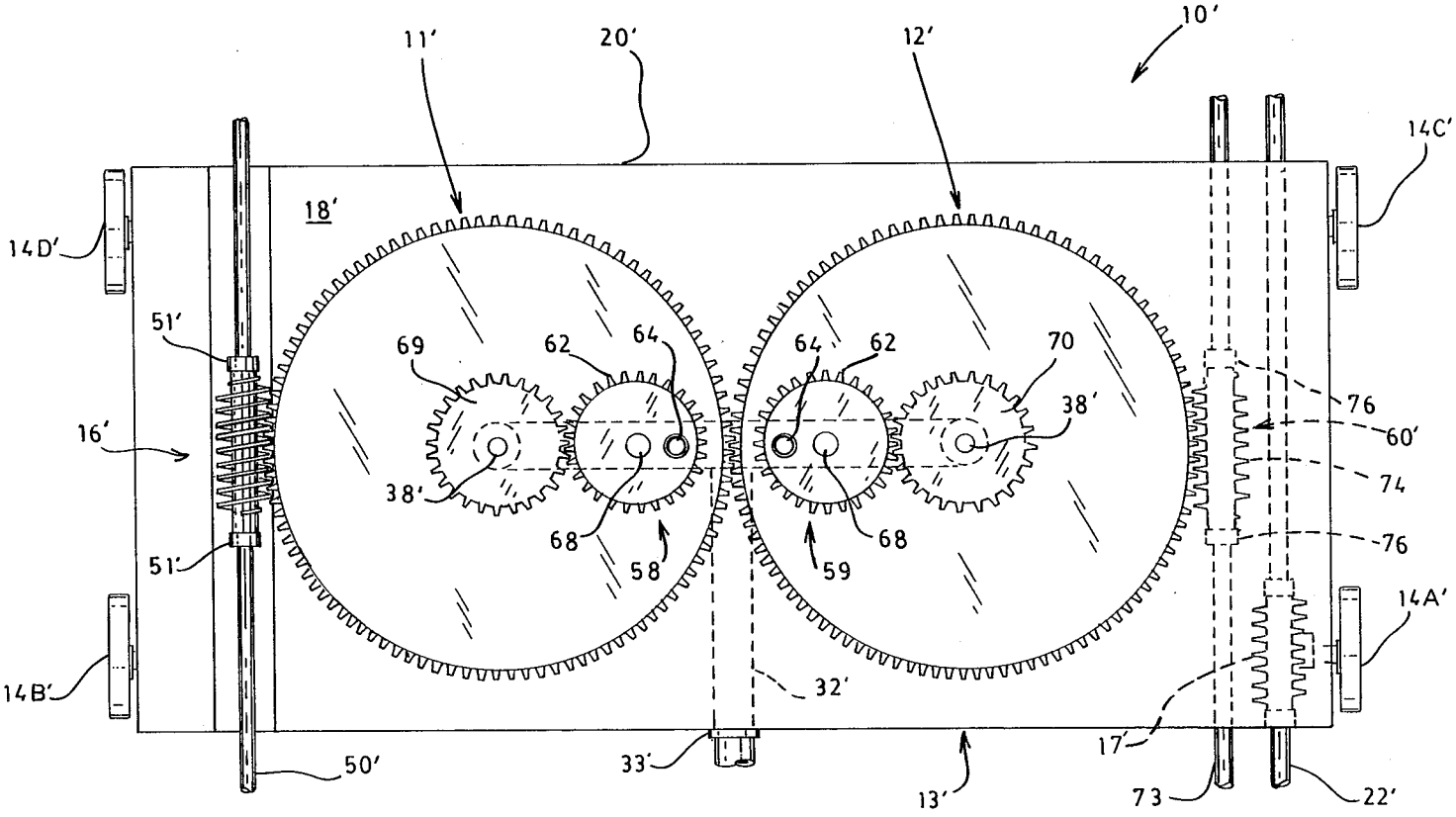
FIG. 2A is a top view of an alternate embodiment of the massage device of the present invention.
Figure 2B:
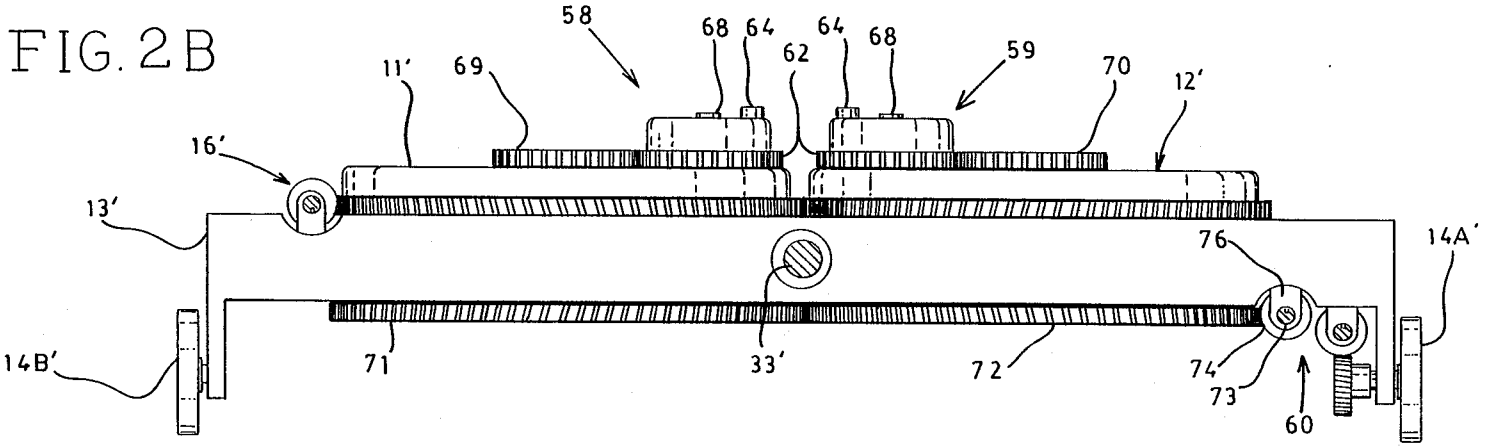
FIG. 2B is a rear view of an alternate embodiment of the massage device of the present invention.
Figure 2C:
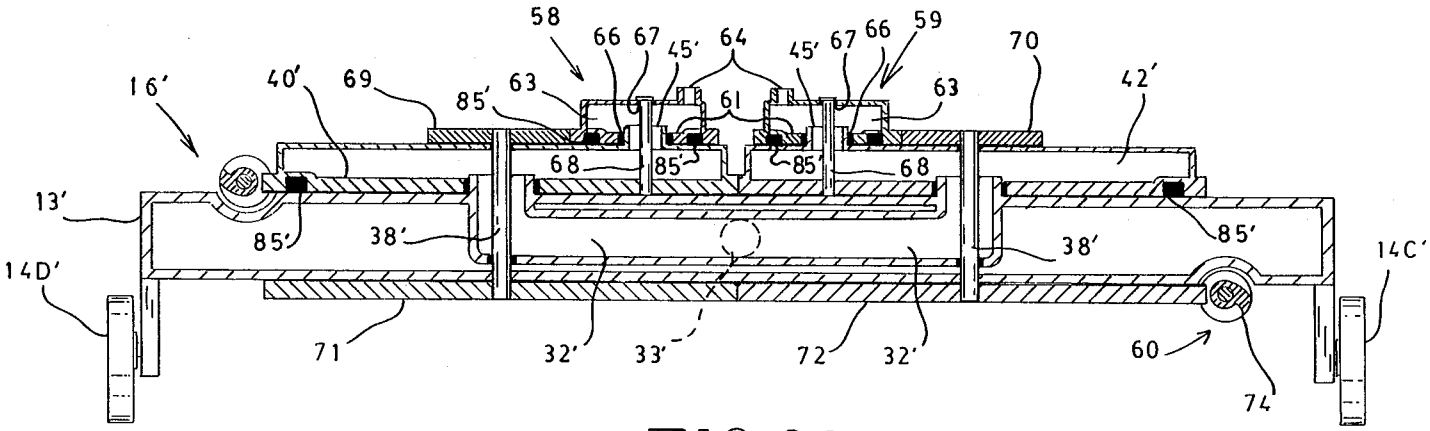
FIG. 2C is a rear view, in section, of an alternate embodiment of the massage device of the present invention.

In the FIGS. 2A through 2C an alternative embodiment of the liquid jet massage device of the present invention is illustrated at 10'. Given that the massage device 10 and the massage device 10' comprise many common structural features, in the discussion of the massage device 10' which follows such common structural features are referenced by common prime numerals.

In addition to the selectively rotatable head members 11' and 12' the device 10' is provided with a pair of secondary head members 58 and 59 rotatably mounted on the head member 11' and 12', respectively, and comprises a third gear assembly 60 for facilitating the selective rotation of the secondary head members 58 and 59. Each of the head members 58 and 59 comprises a circular bottom portion 61 defining a circumferential toothed gear surface 62. Further, each of the secondary head members 58 and 59 defines a reservoir 63 above the bottom portion 61 and is provided with an upwardly directed nozzle 64 defining a conduit for dispensing jets of liquid from the reservoir 63. The bottom portions 61 of each of the head members 58 and 59 are provided with axial opening 66 for rotatably receiving the operatively associated nozzle 45 of one of the head members 11' or 12', and is further provided with an axial hole 67 for rotatably receiving one of the retaining shafts 68. As illustrated, the retaining shafts 68 are secured to the bottom portions 40' of the head members 11' and 12' and extend axially through the conduit defined by the nozzles 45, and serve to rotatably secure the head members 58 and 59 on the head members 11' and 12', respectively. Of course, each of the secondary head members 58 and 59 is provided with a seal member mounted between the retaining shaft 68 and edges of the axial opening 66, and a seal member mounted between the shaft 68 and the edges of the axial hole 67 to insure the liquid impervious integrity of the reservoirs 63. Also, in order to facilitate the free rotation of the head members 58 and 59 on the top portions 43' of the head members 11' and 12', a plurality of selectively spaced roller bearings 85' are mounted between the head members 58 and 59 and the top portions 43'.

As noted above, each of the secondary head members 58 and 59 is provided with an upwardly directed nozzle 64 defining a conduit through which liquid exits the reservoir 63. Thus, it will be appreciated that in the illustrated embodiment of the device 10' liquid is injected under pressure into the inlet port 33' and is carried to the head members 11' and 12' by the conduit 32'. The liquid then travels through the nozzles 45' into the reservoirs 63 to be discharged from the reservoir 63 in massaging jets through the nozzles 64.

In order to selectively rotate the secondary head members 58 and 59 a pair of upper drive gears 69 and 70 are provided which mesh with the gear surfaces 62 of the secondary head members 58 and 59, respectively. As illustrated, the drive gears 69 and 70 are secured to the upper end portions of the mounting shafts 38', and a pair of lower drive gears 71 and 72 are secured to the lower end portions of the mounting shafts 38' such that the gear 71 meshes with the gear 72. Thus, it will be appreciated by those skilled in the art that the rotation of the gear 72 results in the rotation of the gears 71, 70 and 69, and, resultantly, the rotation of the secondary head members 58 and 59. In order to selectively rotate the drive gear 72 a third drive shaft 73 is provided which can be selectively rotated by various motor means, certain of which will be discussed below. The rotation of the shaft 73 is communicated to the drive gear 72 by a third gear assembly 60 which comprises a third worm gear 74 which is journalled between a pair of yoke members 76 and slidably mounted on the drive shaft 73 as discussed above with respect to the worm gear 53 of the gear assembly 16. As illustrated, the worm gear 74 meshes with the drive gear 72 such that rotation of the worm gear 74 rotates the gear 72 and, resultantly, the secondary head members 58 and 59.

It will be appreciated from the discussion above that the head members 11' and 12', and the secondary head members 58 and 59 can be selectively and independently rotated. Accordingly, the jets of liquid discharged from the nozzles 67 can be made to follow a rotational path about the axes of the shafts 68 and about the axes of the shafts 38' simultaneously. The result is a vigorous and highly manipulative massaging action which can be selectively modified by changing the direction and/or rotational speed of the drive shafts 50 and 73.

Figure 3:
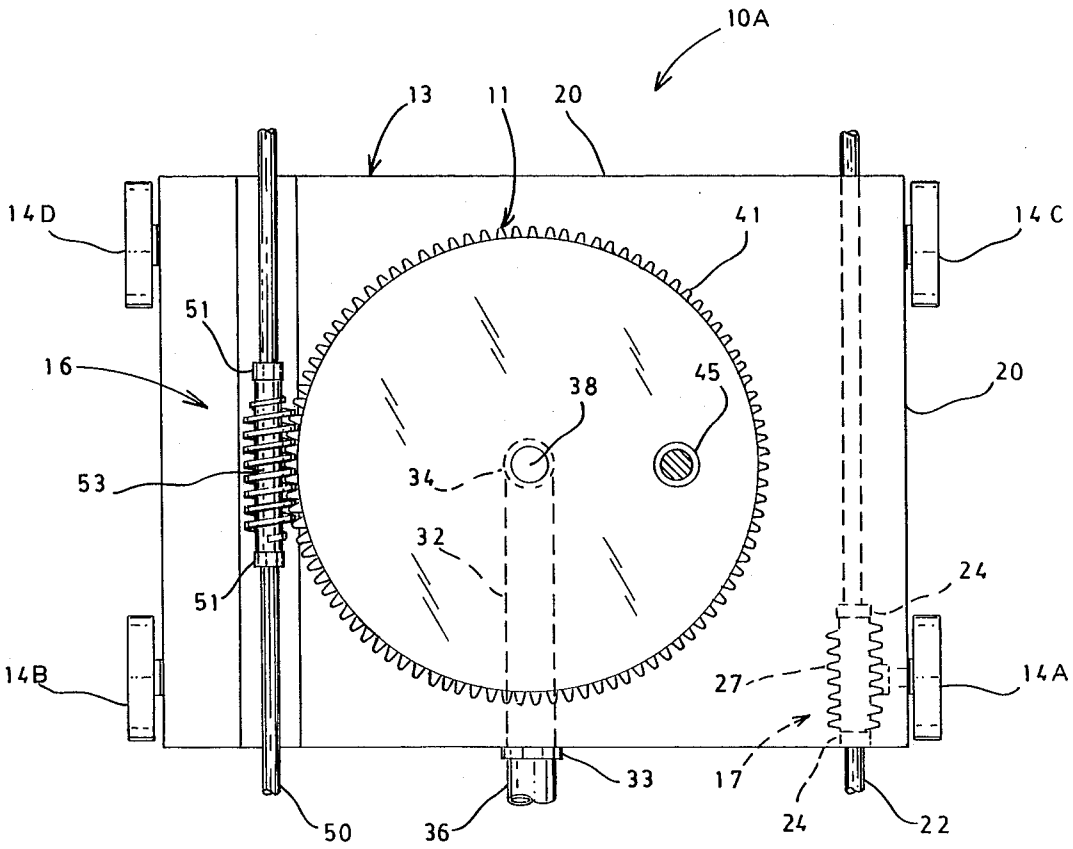
FIG. 3 is a top view of an alternate embodiment of the massage device of the present invention.
Figure 4:
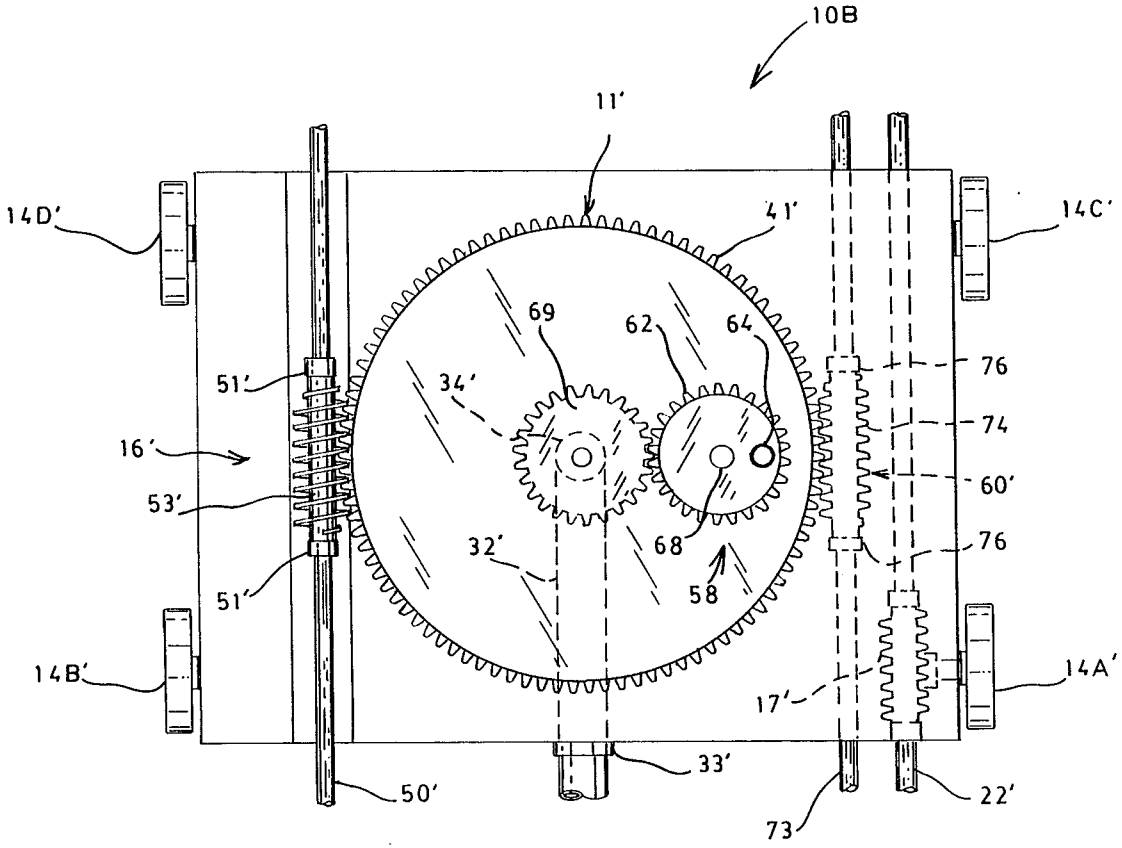
FIG. 4 is a top view of an alternate embodiment of the massage device of the present invention.

Whereas the massage devices 10 and 10' are the preferred embodiments of the massage device of the present invention it is contemplated that it may be desirable to utilize an alternate embodiment which features a single rotating liquid jet rather than the twin liquid jets of the devices 10 and 10'. In this regard, at 10A of FIG. 3 a modification of the device 10 is illustrated, the device 10A having a single rotating head member 11. Similarly, at 10B in FIG. 4 a modification of the device 10' is illustrated, the device 10B having a single rotating head member 11' carrying a single secondary head member 58. It will be appreciated that whereas the devices 10A and 10B produce only one massaging jet of liquid, the devices are more compact and can be utilized in small tub or reservoir.

Figure 5A:
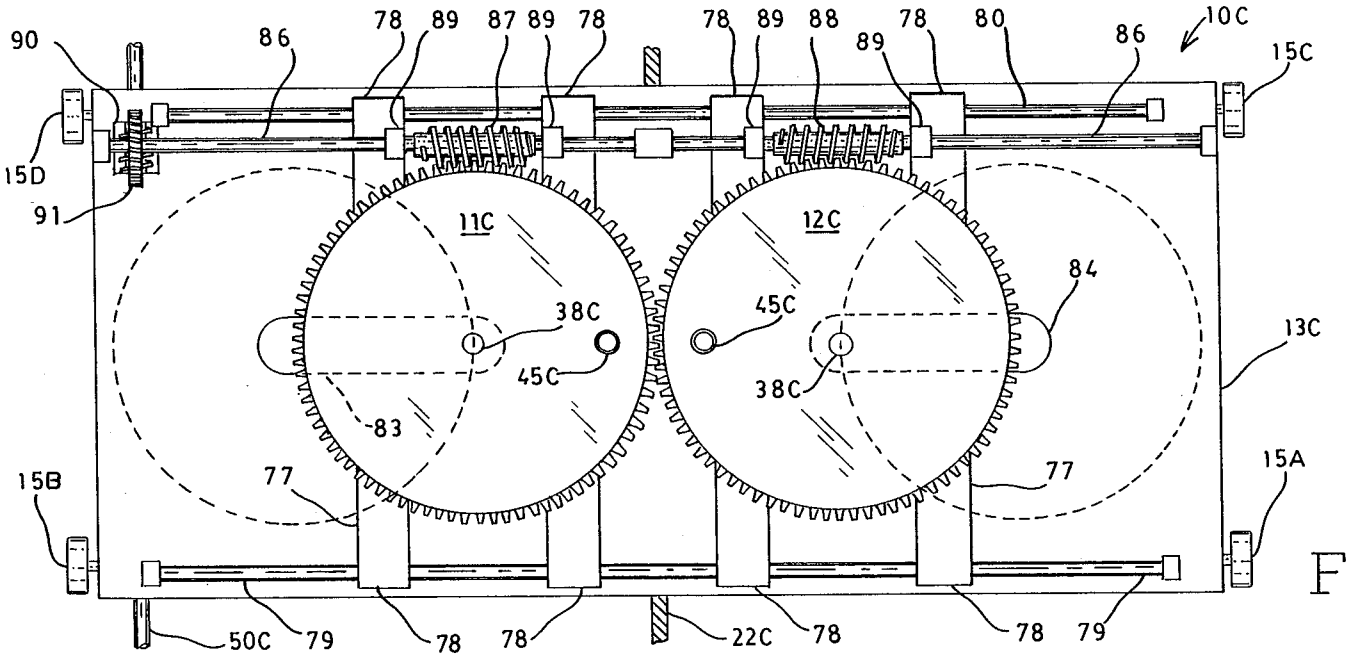
FIG. 5A is a top view of an alternate embodiment of the massage device of the present invention.
Figure 5B:
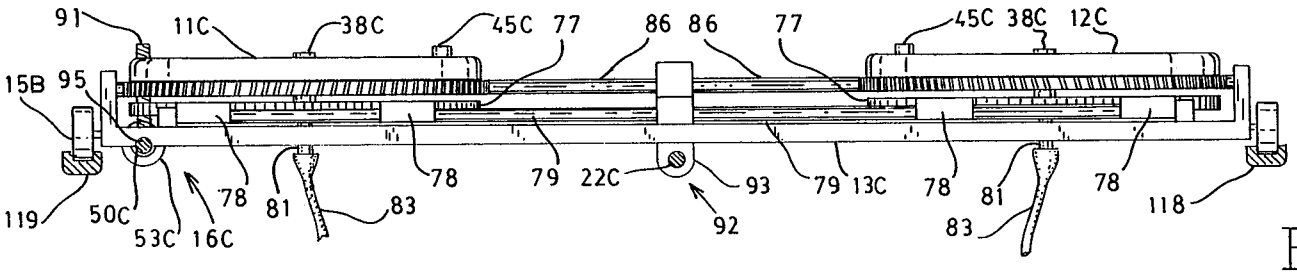
FIG. 5B is a rear view of an alternate embodiment of the massage device of the present invention.

A further embodiment of the massage device of the present invention is illustrated at 10C in FIGS. 5A and 5B. As illustrated, the device 10C comprises a movable carriage 13C provided with rotatable wheel members 15A–D, and a pair of rotating liquid dispensing head members 11C and 12C. It will be understood that the head members 11C and 12C are constructed and function in a similar manner to the head members 11 and 12 of the device 10. However, the head members 11C and 12C are not directly mounted on the carriage 13C, but instead are rotatably mounted on laterally reciprocable base plates 77 such that the head members 11C and 12C can be selectively positioned to allow the distance between the rotating liquid jets to be altered. More specifically, each of the base plates 77 defines the mounting arms 78 for slidably engaging a pair of oppositely disposed rail members 79 and 80 mounted on the carriage 13C.

Figure 5C:
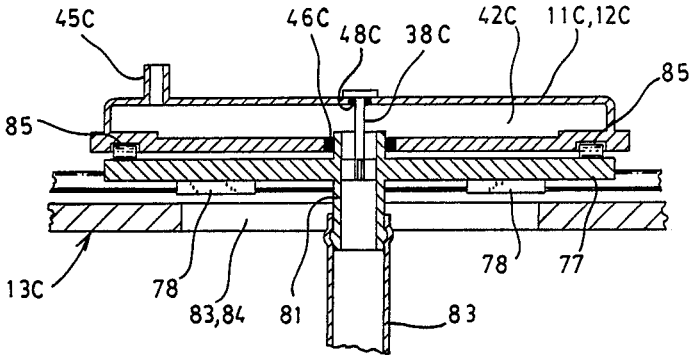
FIG. 5C is a side elevation view, in section, of a base plate and primary head member of an alternate embodiment of the massage device of the present invention.

In order to facilitate the supplying of liquid to the head members 11C and 12C, each of the base plates 77 is provided with an axially disposed conduit 81 having an upper portion which is rotatably received in the axial opening 46C of the operatively associated head member 11C or 12C. (See FIG. 5C) Of course, a suitable seal member is disposed between the conduit 81 and the edges of the axial opening 46C of the head member in order to insure the liquid impervious integrity of the reservoir 42C. Further, the lower end portion of each of the conduits 81 receive a liquid supply hose 83 for supplying liquid to the operatively associated head member 11C or 12C. Thus, liquid is injected, under pressure, with the supply hoses 83 through the conduits 81 and into the reservoirs 42C to be discharged as jets of liquid through the nozzles 45C. It should also be noted that each of the base plates 77 is provided with a mounting shaft 38C axially mounted at its lower end portion in the conduit 81. Each of the shafts 38C is rotatably received through the axial hole 48C in the top portion of the operatively associated head member 11C or 12C and is provided with a retainer cap at its upper end portion for rotatably securing the head member 11C or 12C on the base plate 77. Of course, a suitable seal member is disposed between the shaft 38C and the edges of the axial hole 48C to insure the liquid impervious integrity of the reservoirs 42C. Further, in order to accomodate the reciprocation of the head members 11C and 12C the carriage 13C is provided with a pair of slots 83 and 84 through which the conduits 81 extend. Also, in order to facilitate the free rotation of the head member 11C and 12C on the base plates 77, a plurality of selectively spaced roller bearings 85 are mounted between the head members 11C and 12C and the base plates 77.

In order to accomplish the selective rotation of the head members 11C and 12C the massage device 10C is provided with a drive shaft 86 which is rotatably mounted at its opposite end portions on the carriage 13C. A pair of worm gears 87 and 88 are slidably mounted on the shaft 86 so as to be journalled between the yoke members 89 of the mounting arms 78, the yoke members 89 being rotatably receptive of the shaft 86. It will be understood that the worm gears 87 and 88 are slidably mounted on the shaft 86 in the manner described above with respect to the worm gear 53 and the shaft 50 of the device 10 such that the worm gears 87 and 88 rotate with the shaft 86, yet are free to travel axially along the shaft 86. More specifically, the worm gears 87 and 88 mesh with, and travel with, the head members 11C and 12C, respectively, as the base plates 77 are selectively moved along the rails 79 and 80, with the rotation of the shaft 86 being thereby communicated to the head members.

In order to selectively rotate the shaft 86 a gear assembly 16C is provided for communicating the rotation of the drive shaft 50C to the shaft 86. In this regard, the carriage 13C is provided with a drive shaft receptor 95 for rotatably receiving the drive shaft 50C with an opening 90 being defined in the carriage 13C to accomodate a worm gear 53C which is slidably mounted on the shaft 50 as discussed above with respect to the shaft 50 and the worm gear 53 of the device 10. A drive gear 91 which meshes with the worm gear 53C is mounted on the shaft 86 such that rotation of the gear 91 rotates the shaft 86. Resultantly, by rotating the shaft 50C the worm gear 53 is rotated which in turn rotates the gear 91 and shaft 86. Therefore, it will be appreciated that by driving the head members with separate worm gears and securing each head on an independent base plate, the lateral spacing of the head members 11C and 12C of the device 10C can be altered by suitable means to achieve the most desirable positioning of the massaging jets of liquid.

Figure 10:
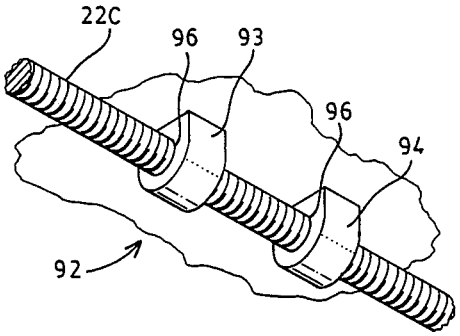
FIG. 10 is a perspective view of an alternate second gear assembly of the present invention.

Whereas it is contemplated that the carriage 13C of the massage device 10C can be driven by a gear assembly similar to the gear assembly 17 of the device 10, in the alternate embodiment illustrated at 10C an alternate drive mechanism 92 is utilized. As is best illustrated in FIG. 10, the mechanism 92 comprises a pair of traveler members 93 and 94 which extend downwardly from the carriage 13C and define registering threaded receptors 96. Rather than a shaft provided with a key way as was the case with the shafts 22 and 53, the mechanism 92 is driven by a threaded shaft 22C which is threadably received in the registering receptors 96 of the traveler members 93 and 94. Thus, it will be appreciated by those skilled in the art that rotation of the shaft 22C results in movement of the carriage 13C along the shaft 22C. It will also be understood that the mechanism 92 can be utilized in connection with the device 10 instead of the gear assembly 17, or with the device 10', instead of the gear assembly 17', if desired.

As discussed above the massage device of the present invention is designed for use in various bathing tubs or spas. However, in one preferred embodiment of the massage device of the present invention a special massage enclosure 97 is provided as illustrated diagrammatically in FIGS. 6A and 6B. The enclosure 97 generally comprises a liquid reservoir 98, a pump housing 99 containing liquid pumping means 100, and a motor housing 101 in which is mounted one or more motors 102. The liquid reservoir 98 is defined by a bottom portion 103, oppositely disposed side walls 104 and 106, and oppositely disposed end walls 107 and 108 Further, the reservoir 98 defines an upper opening 109 which is covered with a liquid impervious body support sheet 110 fabricated of a thin sheet of flexible material such as a thin durable plastic. As illustrated the support sheet supports the body of the individual to be massaged, and whereas the reservoir 98 is filled with liquid, the liquid impervious support sheet 110 keeps the user dry.

Figure 6A:
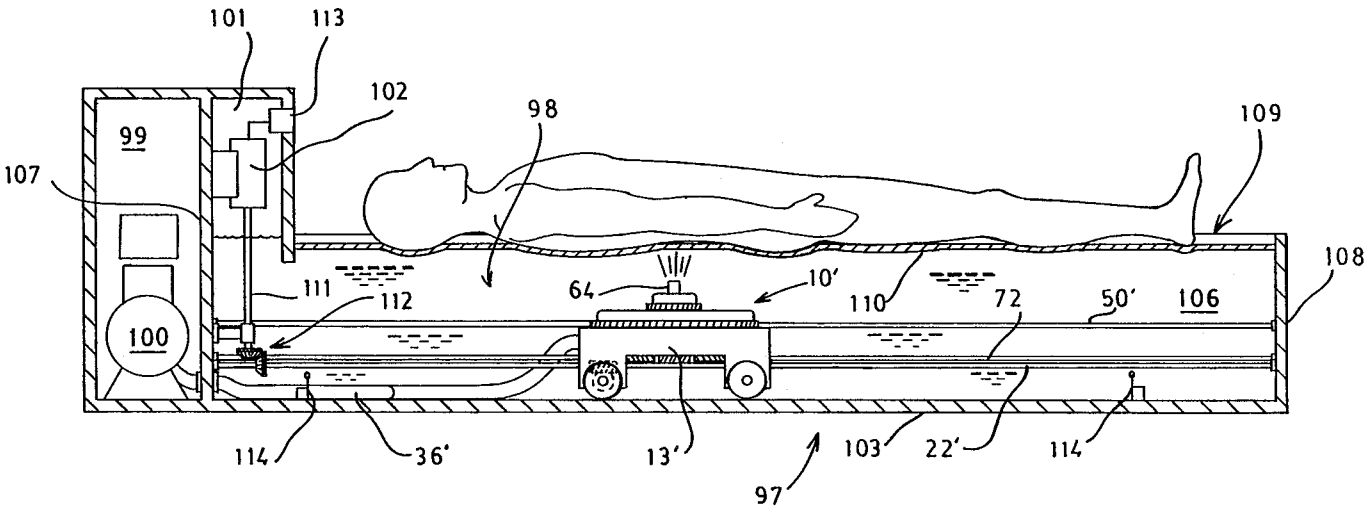
FIG. 6A is a diagrammatic side elevation view, in section, of a massage enclosure of the massage device of the present invention.
Figure 6B:
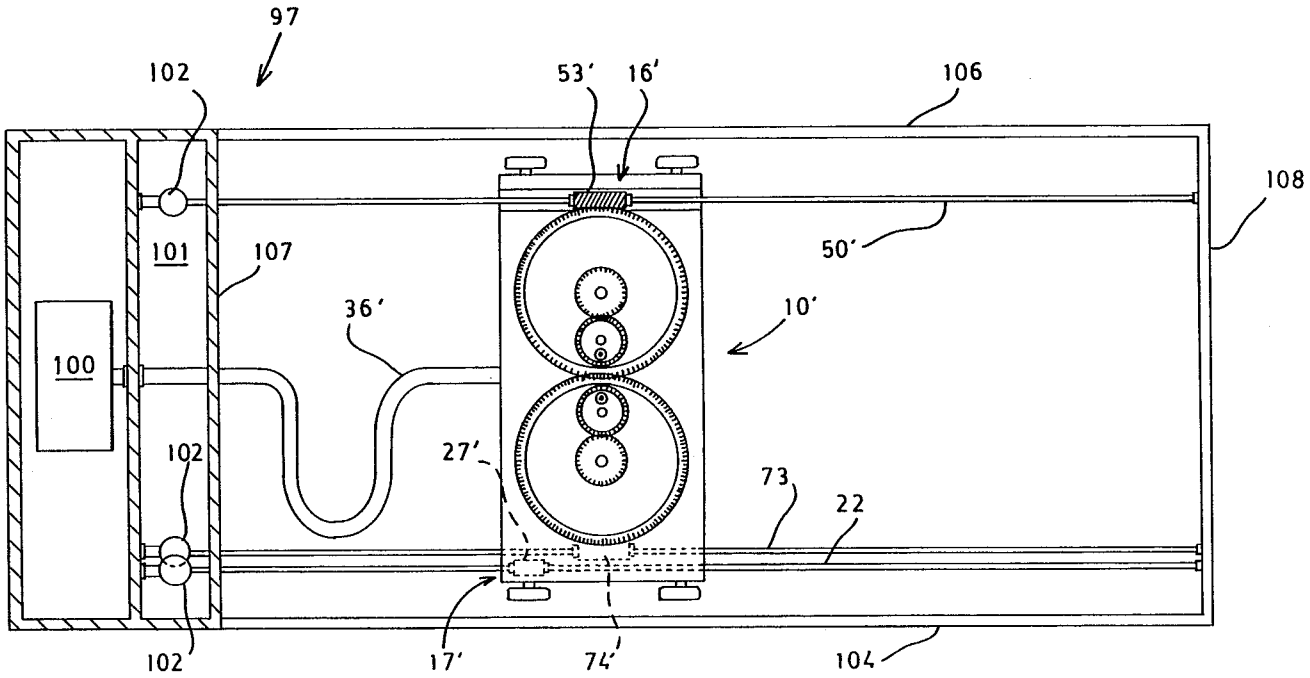
FIG. 6B is a diagrammatic top view, partially in section, of a massage enclosure of the massage device of the present invention.

In the illustrated embodiment of FIGS. 6A and 6B a massage device 10' is positioned within the reservoir 98 such that the carriage 13' is movably supported on the bottom portion 103 and such that the nozzles 64 direct the water jets expelled from the head members 11' and 12' upwardly to impact the support sheet 110. It will be noted, however, that whereas FIGS. 6A and 6B illustrate a device 10' being positioned in the reservoir, it may be desirable to use the device 10 or one of the other embodiments discussed hereinabove instead of the device 10'.

Continuing with regard to the enclosure 97, the drive shafts 22', 50' and 72 are rotatably secured at their opposite end portions to the end walls 107 and 108 so as to span the reservoir 98, and thereby define the reciprocal path of the carriage 13'. In order to selectively rotate the shafts 22', 50' and 72, each such shaft is provided with a motor 102 (only one shown in FIG. 6A) mounted in the motor housing 101, with each motor 102 being provided with a rotating shaft 111 provided at its lower end portion with a suitable transmission 112 for communicating the rotation of the shafts 111 to the operatively associated drive shaft 22', 50' or 72. Thus, the motors 102 serve to rotate the shafts 22', 50' and 72, and as discussed above, rotation of the shaft 22' drives the carriage 13'; rotation of the shaft 50 rotates the head members 11' and 12'; and rotation of the shaft 72 rotates the secondary head members 58 and 59. Of course, in order to alter the direction of travel of the carriage 13', or the direction of rotation of the head members 11' and 12′ or the secondary head members 58 and 59, suitable switching means are provided for selectively reversing the rotation of the motors 102. In this regard it may be desirable to provide exterior control means for electrically manipulating the rotational direction and speed of the motors 102 as diagrammatically illustrated at 113, and/or automatic switch means for actuating a reversal of motor rotation responsive to contact with the device 10′ as diagrammatically illustrated at 114.

In light of the above it will be appreciated that liquid under pressure is pumped to the device 10′ with the pump means 100, liquid communication between the pump means 100 and the device 10′ being establish with the flexible hose 36′. Resultantly, jets of liquid are expelled from the nozzles 64 and impact the support sheet 110 with this massaging impact being communicated to the user through the sheet 110. Of course, the traveling carrage 13′ allows the massaging jets to be moved to massage specific portions of the users body, or the carriage can simply be reciprocated along the drive shaft 22′ producing a full body massage.

Figure 7:
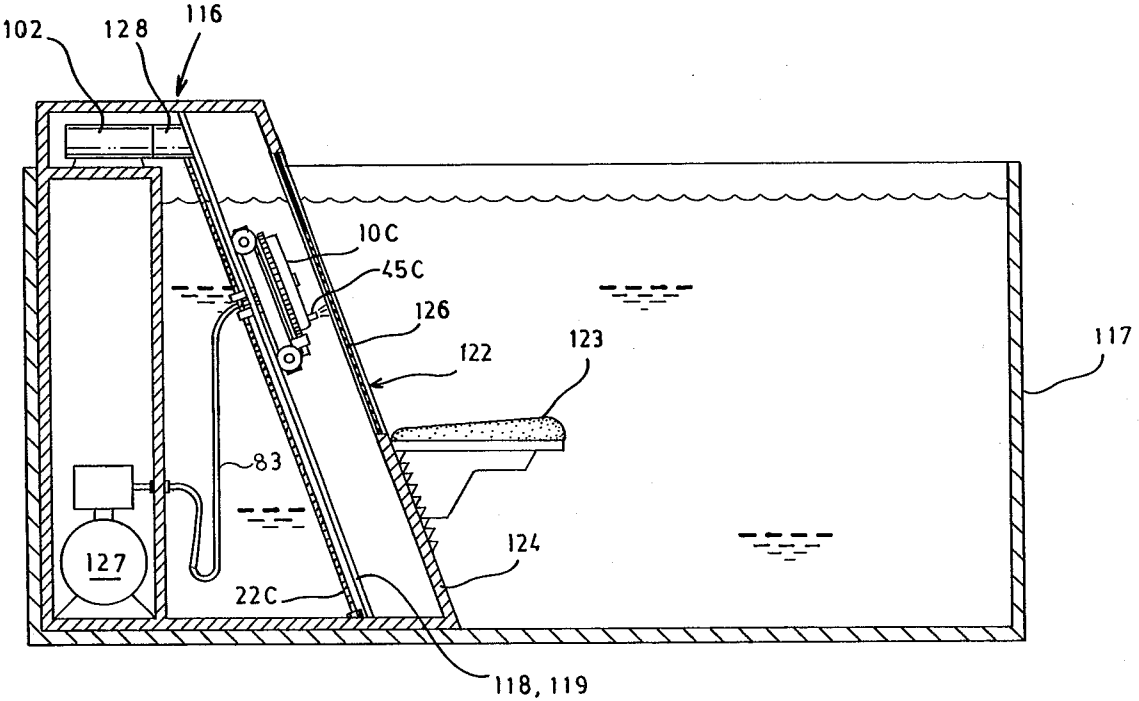
FIG. 7 is a diagrammatic side elevation view of a massage housing of the massage device of the present invention.

In yet another embodiment the massage device of the present invention is provided with a massage housing 116 as is diagrammatically illustrated in FIG. 7. The housing 116 is designed to be positioned in a bathing tub such as the illustrated tub 117. In the illustrated embodiment of FIG. 7 a device 10C is utilized in conjunction with the housing 116. However, it will be understood that the housing 116 can be utilized with the device 10 or any of the other embodiments of the massage device hereinabove described.

As illustrated the device 10C (see FIG. 5A) is mounted on a pair of track members 118 and 119 and is oriented for nearly vertical reciprocation. A motor 120, with suitable transmission means 128, is provided for selectively rotating the threaded shaft 22C, the rotation of which causes movement of the carriage 13C as discussed hereinabove. Thus, by manipulating the rotational direction and speed of the motor 120 with suitable control means (not shown), the device 10C can be selectively moved up and down the track members 118 and 119. The housing 116 comprises a forward wall 124 defining a window portion 122 through which the nozzles 45C of the device 10C direct their massaging jets of liquid. In the preferred embodiment a seat member 123 is mounted on the forward wall 124 for supporting the user during the massage operation. However, it will be understood that in a small tub the seat member 123 can be omitted and the user can be seated on the bottom portion of the tub. Further, a mesh screen 126 is mounted in the window portion 122 for supporting the back of the user while still allowing the jets of liquid from the nozzles 45C to impact the body of the user. Thus, during operation of the massage device the user sits in the seat member 123 with his or her back against the screen 126. Liquid is pumped through the flexible hoses 83 by the pump means 127 and into the device 10C to produce jets of liquid for impacting the body of the user. Whereas in FIG. 7 the drive shaft 50C is not illustrated, it will be appreciated that a motor and suitable transmission means are positioned adjacent to the motor 120 and transmission means 128 for rotating the shaft 50C, and thus rotate the head members 11C and 12C.

In light of the above it will be appreciated that the massage device of the present invention produces one or more massaging jets of liquid for impacting the body of the user. The device of the present invention not only provides for linear movement of the liquid jets through movement of the movable carriage to allow the jets to reach all parts of the body, but provides for rotational movement of the jets through the selective rotation of the various head members to provide a vigorous massage that is both pleasurable and therapeutic.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A liquid jet massage device for producing selectively rotating jets of liquid for massaging the body of a user, said message device being actuated by a plurality of drive shafts selectively rotated with suitable motor means, said device comprising:

a movable carriage provided with a conduit for carrying said liquid, said conduit defining an inlet port and two outlet ports;

first and second liquid dispensing primary head members rotatably mounted on said movable carriage, said head members each comprising a bottom portion and a top portion, said primary head members each defining a liquid reservoir for receiving said liquid from said conduit of said carriage, said bottom portion of said primary head members defining an axial opening for establishing liquid communication between said reservoirs and said conduit, said top portions each being provided with an axially displaced nozzle defining a nozzle conduit for discharging said liquid from said reservoirs, said first and second primary head members each further defining a circumferential gear surface;

a first gear assembly operatively associated with one said drive shaft, said first gear assembly engaging said circumferential gear surface of said first and second primary head members to facilitate the selective rotation thereof; and a second gear assembly operatively associated with one said drive shaft for facilitating the selective travel of said movable carriage.

2. the massage device of claim 1 wherein said device further comprises first and second liquid dispensing secondary head members, said first secondary head member being rotatably mounted on said first primary head member and said second secondary head member being rotatably mounted on said second primary head member, each said first and second secondary head member comprising a bottom portion and a top portion, each said secondary head member defining a liquid reservoir for receiving said liquid, said bottom portion of each said secondary head member defining an axial opening for rotatably receiving said axially displaced nozzle of one said primary head member, whereby liquid communication is established between said reservoir of said secondary head member and said reservoir of said primary head member, said top portion of each said secondary head member being provided with an axially displaced secondary nozzle defining a nozzle conduit for discharging said liquid from said reservoir of said secondary head member, each said secondary head member further defining a circumferential gear surface, and wherein said device further comprises a third gear assembly for facilitating the selective rotation of said first and second secondary head members.

3. The massage device of claim 1 wherein said movable carriage is provided with first, second, third and forth wheel members and an operatively associated axle for mounting each said wheel on said carriage and wherein said second gear assembly comprises a pair of selectively spaced yoke members mounted on said carriage, each said yoke member defining a hole for receiving one said drive shaft operatively associated with said second gear assembly, said second gear assembly further comprising a first worm gear positioned between said yoke members and slidably mounted on said drive shaft operatively associated with said second gear assembly, and comprises a wheel drive gear mounted on said axle operatively associated with said first wheel member so as to rotate with said axle of said first wheel member, said wheel drive gear being oriented so as to mesh with said first worm gear, whereby selective rotation of said drive shaft operatively associated with said second gear assembly causes rotation of said first worm gear and rotation of said wheel drive gear, thereby rotating said first wheel member.

4. The massage device of claim 1 wherein said carriage comprises a pair of selectively spaced rail members mounted on said carriage in substantially parallel alignment, and comprises first and second base plate members slidably supported on said rail members, each said first and second base plate member being provided with one said liquid supply conduit for carrying said liquid, and wherein said first primary head member is rotatably mounted on said first base plate such that said axial opening of said first primary head member communicates with said outlet port of said liquid supply conduit of said first base plate, and said second primary head member is rotatably mounted on said second base plate such that said axial opening of said second primary head member communicates with said outlet port of said liquid supply conduit of said second base plate, said first gear assembly including a first drive gear for rotatably engaging said circumferential gear surface of said first primary head member to facilitate the selective rotation of said first primary head member, and including a second drive gear for rotatably engaging said circumferential gear surface of said second primary head member to facilitate the selective rotation of said second primary head member.

5. The massage device of claim 1 wherein said carriage is provided with a plurality of rotatable wheel members, and wherein said device further comprises a massage housing for housing said movable carriage, and at least a first and second said drive shaft provided with motor means for selectively rotating said first and second drive shafts, said housing further comprising a pair of track members for rotatably engaging said wheel members of said carriage so as to movably support said carriage, said housing comprising a forward wall defining a window portion through which said jets of liquid are discharged, said window portion being covered with a mesh screen for supporting said body of said user.

6. The massage device of claim 1 wherein said circumferential gear surface of said first primary head member is meshed with said circumferential gear surface of said second primary head member whereby selective rotation of said first primary head member by said first gear assembly results in rotation of said second primary head member.

7. A liquid jet message device for producing selectively rotating jets of liquid for massaging the body of a user, said massage device being actuated by a plurality of drive shafts selectively rotatable with suitable motor means, said device comprising:

a movable carriage provided with a conduit for carrying said liquid, said conduit defining an inlet port and at least one outlet port;

at least one liquid dispensing primary head member rotatably mounted on said movable carriage, said head member comprising a bottom portion and a top portion, said primary head member defining a primary liquid reservoir for receiving said liquid from said conduit of said carriage, said bottom portion of said primary head member defining an axial opening for establishing liquid communication between said primary reservoir and said conduit, said top portion being provided with an axially displaced nozzle defining a nozzle conduit for discharging said liquid from said primary reservoir, said primary head member further defining a circumferential gear surface;

at least one liquid dispensing secondary head member rotatably mounted on said primary head member, said secondary head member having a bottom portion and a top portion, said secondary head member defining a secondary liquid reservoir for receiving said liquid, said bottom portion of said secondary head member defining an axial opening for rotatably receiving said axially displaced nozzle of said primary head member whereby liquid communication is established between said primary reservoir and said secondary reservoir, said top portion of said secondary head member being provided with an axially displaced secondary nozzle defining a nozzle conduit for discharging said liquid from said secondary reservoir, said secondary head member further defining a circumferential gear surface;

a first gear assembly operatively associated with one of said drive shafts for rotatably engaging said circumferential gear surface of said at least one said primary head member for facilitating said selected rotation of said primary head member;

a second gear assembly operatively associated with said carriage and with a second of said drive shafts for facilitating selective travel of said movable carriage; and a third gear assembly operatively associated with said circumferential gear of said secondary head member for facilitating selective rotation of said secondary head member.

8. The massage device of claim 7 wherein said first gear assembly comprises a pair of selectively spaced yoke members mounted on said carriage, each said yoke member of said first gear assembly defining a hole for rotatably receiving one said drive shaft operatively associated with said first gear assembly, said first gear assembly further comprising a second worm gear positioned between said yoke members of said first gear assembly and slidably mounted on said drive shaft operatively associated with said first gear assembly, said second worm gear being positioned to mesh with said circumferential gear surface of said first primary head member, whereby rotation of said second worm gear rotates said first primary head member.

9. The massage device of claim 7 wherein said carriage is provided with at least one rotatable mounting shaft extending through said carriage to be axially and rotatably received through said primary head member, said mounting shaft having an upper end portion and a lower end portion, and wherein said third gear assembly comprises an upper drive gear and a lower drive gear said upper drive gear being secured to said upper end portion of said mounting shaft so as to rotate with said mounting shaft, said upper drive gear being positioned so as to mesh with said circumferential gear surface of said secondary head member, said lower drive gear being mounted on said lower end portion of said mounting shaft so as to rotate with said mounting shaft, said third gear assembly further comprising a pair of yoke members mounted on said carriage, each said yoke member of said third gear assembly defining a hole for rotatably receiving said drive shaft operatively associated with said third gear assembly, said third gear assembly comprising a third worm gear positioned between said yoke members of said third gear assembly and slidably mounted on said drive shaft operatively associated with said third gear assembly so as to rotate therewith, said third worm gear being positioned to mesh with said lower drive gear, whereby rotation of said worm gear rotates said lower drive gear, said mounting shaft and said upper drive gear.

10. A liquid jet massage device for producing selectively rotating jets of liquid for massaging the body of a user, said device comprising:

a massage enclosure defining a liquid reservoir, a motor housing, and comprising at least a first and second motor means mounted in said motor housing for selectively rotating said first and second drive shafts, respectively, said enclosure being further provided with pump means for pumping said liquid;

a movable carriage positioned within said reservoir of said massage enclosure, said carriage being provided with a conduit for carrying said liquid, said conduit defining an inlet port and at least one outlet port;

at least one liquid dispensing primary head member rotatably mounted on said movable carriage, said head member comprising a bottom portion and a top portion, said primary head member defining a liquid reservoir for receiving said liquid from said conduit of said carriage, said bottom portion of said primary head member defining an axial opening for establishing liquid communications between said reservoir of said primary head member and said conduit, said top portion being provided with an axially displaced nozzle defining a nozzle conduit for discharging said liquid from said reservoir, said primary head member further defining a circumferential gear surface;

a first gear assembly operatively associated with said first drive shaft for rotatably engaging said circumferential gear surface of said primary head member for facilitating the selective rotation of said primary head member; and a second gear assembly operatively associated with said second drive shaft for facilitating the selective travel of said movable carriage.

11. The massage device of claim 10 wherein said reservoir of said massage enclosure defines an upper opening, and a substantially liquid impervious support sheet covering said upper opening for supporting said body of said user.

12. A liquid jet message device for producing selectively rotating jets of liquid for massaging the body of a user, said massage device being actuated by a plurality of drive shafts selectively rotated with suitable motor means, said device comprising:

a movable carriage provided with a conduit for carrying said liquid, said conduit defining an inlet port and at least one outlet port, said carriage being provided with a plurality of wheel members to support said carriage on a surface, each said wheel member mounted upon an operatively associated axle carried by said carriage, at least one of said axles being provided with a drive gear;

at least one liquid dispensing primary head member rotatably mounted on said movable carriage, said head member comprising a bottom portion and a top portion, said primary head member defining a liquid reservoir for receiving said liquid from said conduit of said carriage, said bottom portion of said primary head member defining an axial opening for establishing liquid communications between said reservoir and said conduit, said top portion being provided with an axially displaced nozzle defining a nozzle conduit for discharging said liquid from said reservoir, said primary head member further defining a circumferential gear surface;

a first gear assembly operatively associated with one said drive shaft for rotatably engaging said circumferential gear surface of at least one said primary head member for facilitating the selected rotation of said primary head member; and a second gear operatively associated with one said drive shaft for facilitating the selective travel of said movable carriage, said second gear assembly including (a) a pair of selectively spaced yoke members mounted on said carriage, each of said yoke members defining a hole for receiving said drive shaft operatively associated with said second gear assembly; and (b) a first worm gear positioned between said yoke members, said first worm gear slidably mounted on said drive shaft received in said holes in said yoke members and adapted for rotation with said shaft, said first worm gear positioned to be meshed with said drive gear on said at least one wheel axle whereby selective rotation of said drive shaft received in said holes of said yoke members rotates said first worm gear thereby rotating said at least one axle and said wheel thereby facilitating said selective travel of said carriage.

* * * * *